US005480176A

United States Patent [19]

Sims

[11] Patent Number: 5,480,176

[45] Date of Patent: Jan. 2, 1996

[54] EXTERNAL MOUNTED BINDING

[76] Inventor: Thomas P. Sims, 340 Calle Liptizana, Goleta, Calif. 93117

[21] Appl. No.: 183,079

[22] Filed: Jan. 18, 1994

[51] Int. Cl.[6] ..... A63C 9/12

[52] U.S. Cl. ..... 280/618; 280/620; 280/14.2

[58] Field of Search ..... 280/619, 620, 280/614, 617, 618, 624, 633, 634, 607, 14.2; D21/229, 230; 441/70

[56] References Cited

U.S. PATENT DOCUMENTS

| | | | |
|---|---|---|---|
| Re. 33,544 | 2/1991 | Dennis | 280/618 |
| D. 308,997 | 7/1990 | Katz | D21/230 |
| D. 346,419 | 4/1994 | Carpenter | D21/230 |
| 2,165,547 | 7/1939 | Hill | 280/617 |
| 4,964,649 | 10/1990 | Chamberlin | 280/618 |
| 4,969,655 | 11/1990 | Katz | 280/14.2 |
| 4,973,073 | 11/1990 | Raines et al. | 280/624 |
| 4,979,760 | 12/1990 | Derrah | 280/607 |
| 5,028,068 | 7/1991 | Donovan | 280/618 |
| 5,090,722 | 2/1992 | Ritchie et al. | 280/607 |
| 5,172,924 | 12/1992 | Barci | 280/14.2 |
| 5,190,311 | 3/1993 | Carpenter | 280/618 |
| 5,261,689 | 11/1993 | Carpenter et al. | 280/618 |
| 5,409,244 | 4/1995 | Young | 280/14.2 |

FOREIGN PATENT DOCUMENTS

| | | | |
|---|---|---|---|
| 0437172B1 | 1/1990 | European Pat. Off. . | |
| 0393383B1 | 3/1990 | European Pat. Off. . | |
| 0424846B1 | 10/1990 | European Pat. Off. . | |
| 0465794B1 | 5/1991 | European Pat. Off. . | |
| 0595170A1 | 10/1993 | European Pat. Off. . | |
| 0595176A1 | 10/1993 | European Pat. Off. . | |
| 0532951 | 8/1929 | Germany | 280/619 |
| 9314835 | 8/1993 | WIPO . | |
| 9300867 | 9/1993 | WIPO . | |
| 9302904 | 10/1993 | WIPO . | |
| 9301038 | 10/1993 | WIPO . | |
| 9421339 | 9/1994 | WIPO . | |

OTHER PUBLICATIONS

Photographs of bindings which were used by Applicant in public more than one (1) year before filing date of application.

*Primary Examiner*—Anne Marie Boehler
*Attorney, Agent, or Firm*—Knobbe, Martens, Olson & Bear

[57] ABSTRACT

A snowboard binding system comprises a toe strap, an ankle strap, a heel loop and two pods. The pods, mounted to the surface of a snowboard, are located at the outside footprint of the rider's boot. The pods allow the snowboard rider to rotate the binding to various angles, to adjust the width of the binding to accommodate his foot and to modify the distance between the two bindings to accommodate the rider's stance. In addition, the rider's center of gravity is lowered, thereby increasing the rider's sensitivity to the board and enabling the rider to hold a better edge while turning.

5 Claims, 3 Drawing Sheets

EXTERNAL MOUNTED BINDING

FIELD OF THE INVENTION

The present invention relates to snowboard bindings, and, in particular, to a snowboard binding system that mounts directly onto the board at the perimeter of the foot.

BACKGROUND OF THE INVENTION

The sport of snowboarding is a result of the combination and modification of various elements from the skiing and skateboarding sports. However, unlike snowskiing and skateboarding, snowboarding requires that both feet of the rider be attached to a single board. Waterskiing, too, differs from snowboarding in that the waterskiier is simply pulled by a boat, whereas a snowboard rider's primary motive force is gravity. In addition, the snowboard rider must be able to assume a variety of body positions in order to maneuver the board. Therefore, the binding or apparatus used to attach the snowboard rider's feet to the board should provide enough strength and positional versatility to meet the above requirements and each different riding style.

Traditional snowboard binding systems are comprised of molded, plastic footplates that are mounted to the snowboard via machine screws and inserts. The snowboard bindings include toe and heel straps or clips which are used to secure to rider's boot to the binding system. In order to properly mount the binding onto the snowboard, the rider must first determine the appropriate step-span and rotational positions for his feet. After this is accomplished, the binding is mounted onto the snowboard.

A disadvantage associated with the above mentioned snowboard binding is the lack of positional fine adjustment. Snowboards are typically manufactured with a predetermined pattern of threaded inserts. Art example of such a pattern is a 4 cm×4 cm square. Thus, the binding can only be rotationally adjusted by increments of 12 degrees and longitudinally adjusted by increments of 4 cm.

In order to provide greater rotational versatility, snowboard binding systems, comprised of a hold-down plate and a binding plate, were developed. For this particular type of binding system, the binding plate is held at the desired rotational orientation and the hold-down plate is mounted onto the binding plate and, subsequently, screwed into the snowboard. Although this binding system allows for an infinite number of rotational positions, it is still limited in the number of longitudinal positions available for the snowboard rider.

Due to the above mentioned disadvantages associated with traditional binding systems, there is a need for a snowboard binding system which provides the snowboard rider with adequate positional versatility to accommodate a variety of riding stances and maneuvers.

SUMMARY OF THE INVENTION

The present invention relates to snowboard binding systems and, in particular, to a snowboard binding system which offers the snowboard rider a variety of rotational and longitudinal adjustments for foot positioning.

In the preferred embodiment, the snowboard binding system of the present invention is comprised of a heel loop, a toe strap, an ankle strap and two pods. The toe and ankle straps of the present invention are similar to those used with traditional snowboard bindings. The heel loop is also similar to heel loops used on traditional bindings except that the heel loop of the present invention is able to slide back and forth. This added feature enables the rider to accurately center his foot from heel to toe on the board simply by adjusting the screws that attach the heel loop to the pods of the binding.

An important feature of the present invention is the unique design of the pods. Each pod is in the shape of a half-disk; although, this pod configurations are possible. Vertical side walls extend around the perimeter of each half-disk and are used to give the pods added strength and stiffness. The pods attach to the snowboard via screws which are inserted through the screw-receiving holes located on the surface of each half-disk. The screw-receiving holes are arranged in a repeating radial pattern that follows the radius of curvature of each half-disk. In the preferred embodiment, the radial pattern of the screw-receiving holes is repeated three times, whereby the holes nearest the straight edge of the half-disk comprise a pattern of holes with a smaller radius of curvature than the holes nearest the curved edge of the half-disk.

Each component of the snowboard binding system of the present invention is molded as a separate piece and then assembled together to form the resultant snowboard binding of the present invention. However, instead of mounting the binding to the board under the rider's foot, the binding is mounted to the board on the perimeter of the foot, via the pods. Thus, the foot of the rider is not contained within a binding having footplates but is externally mounted with respect to the binding. Therefore, by mounting the binding to the outside footprint of the rider's boot, there is nothing between the sole of the rider's boot and the surface of the snowboard.

There are three main advantages associated with the foot plateless snowboard binding of the present invention. First, by removing that portion of the binding that is typically beneath the rider's feet, the rider's center of gravity is lowered. Second, by standing directly on the board, the rider has a better feel of and added sensitivity to the board. Third, due to the versatile design of the pods, the binding of the present invention offers numerous adjustment possibilities for the snowboard rider to customize his exact position on the board.

An additional advantage associated with the foot plateless binding system is added board flexibility. This is due to the specific size, shape and location of the pods. In general, there are two pods per rider's foot. One pod is mounted onto the snowboard located near the outside of the rider's foot and the other pod is mounted onto the snowboard located near the inside of the rider's foot. Since the foot plateless binding system is attached to the snowboard at two locations, each binding of the present invention covers a smaller amount of the snowboard's surface area at each binding location than the bindings of traditional binding systems. Thus, the particular configuration of the pods allows the board to flex between the pods, thereby giving the snowboard better overall flexibility.

DETAILED DESCRIPTION OF THE PREFERRED EMBODIMENTS

Figure 1:
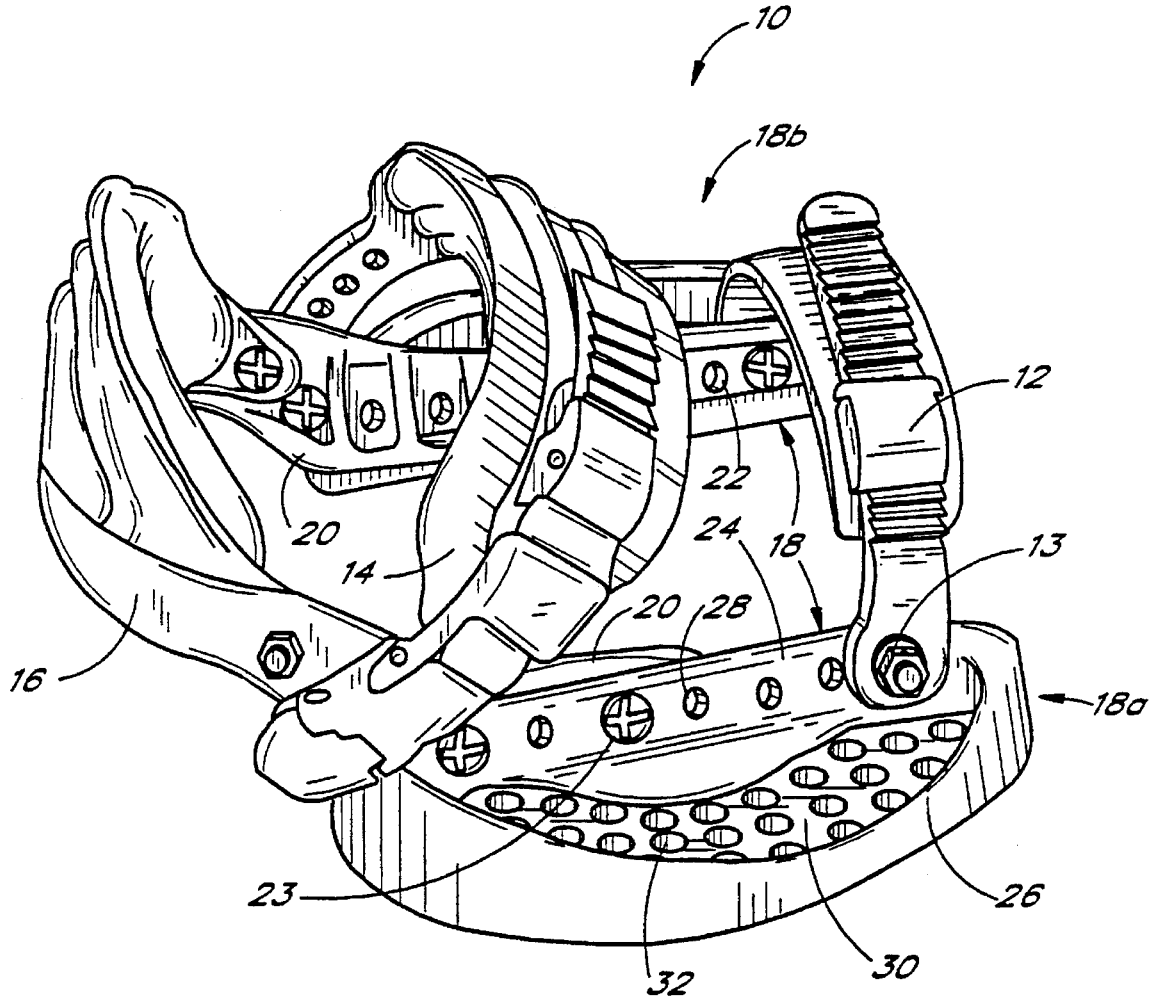
FIG. 1 is a perspective view illustrating the external mounted snowboard binding of the present invention, comprising a toe strap, an ankle strap, a heel loop and two pods.

For the purposes of promoting an understanding of the principles of the invention, reference will now be made to the embodiment illustrated in the drawings and specific language will be used to describe the same. It will nevertheless be understood that no limitation of the scope of the invention is thereby intended, such as alterations and further modifications in the illustrated device, and such further applications of the principles of the invention as illustrated therein being contemplated as would normally occur to one skilled in the art to which the invention relates.

Referring to FIG. 1, there is shown the snowboard binding system 10 of the present invention comprising a toe strap 12, an ankle strap 14, a heel loop 16 and two pods 18. The components are molded as separate pieces, typically made of plastic, and assembled together to form the resultant binding system 10. However, other comparable materials may also be used, in addition to various manufacturing techniques. The binding system 10 of FIG. 1 illustrates a binding used to secure the right foot of the snowboard rider to the snowboard. It should be noted that the binding system 10 for the left foot of the rider is simply a mirror image of the binding system 10 for the right foot of the rider. For ease of description, only the binding system 10 for the right foot will be described; although, it will be understood that both binding systems 10 are similar.

Each pod 18*a*,18*b* of the present invention illustrated in FIG. 1 is in the shape of a half-disk and comprises a vertical internal wall 24, a vertical external wall 26 and a base 30. For ease of description, only a single pod 18*a* will be described; although, it will be understood that both pods 18 are similar. In the preferred embodiment, the pod 18*a* length is 19 cm and the width is 6.8 cm. However, the pod 18*a* configuration is not limited to these specific dimensions. Thus, the minimum acceptable pod 18*a* length is 5 cm and the maximum length is 25 cm. In addition, the minimum acceptable pod 18*a* width is 2 cm and the maximum width is 10 cm.

Located along the base of the pod 18*a* is a pattern of screw-receiving holes 32. These holes 32, in combination with machine screws, are used to secure the pod 18*a* to the surface of the snowboard (not shown). The pattern and function of the holes 32 and the pod 18*a* will be more fully explained later in the description with reference to FIGS. 3–5.

Still referring to FIG. 1, a series of screw-receiving holes 28 are located along the internal wall 24 of the pod 18*a*. These holes 28 are used as an adjustment means for the heel loop 16, which will be explained in more detail below in connection with FIG. 2. In addition, the holes 28 are used to attach or secure the toe strap 12 to the pod 18*a*. This is accomplished by aligning the hole in the toe strap 12 with a hole 28 in the internal wall 24 of the pod 18*a* and securing the two pieces together with a screw 13.

The toe 12 strap, ankle 14 strap and heel loop 16 of the binding system 10 illustrated in FIG. 1 are similar to those used with traditional snowboard binding systems. However, the heel loop 16 also comprises adjustment arms 20 which enable the rider to adjust the location of the heel loop 16. Each adjustment arm has a series of heel loop adjustment holes 22 which are used to secure the heel loop adjustment arms 20 to the pods 18 via screws 23. Thus, for a rider with small feet, the heel loop 16 would be moved forward, toward the toe of the rider. The holes 22 on the heel loop adjustment arms 20 would be aligned with the holes 28 in the internal wall 24 of the pods 18 and screws 23 would be used to secure the heel loop 16 in the proper position.

Figure 2:
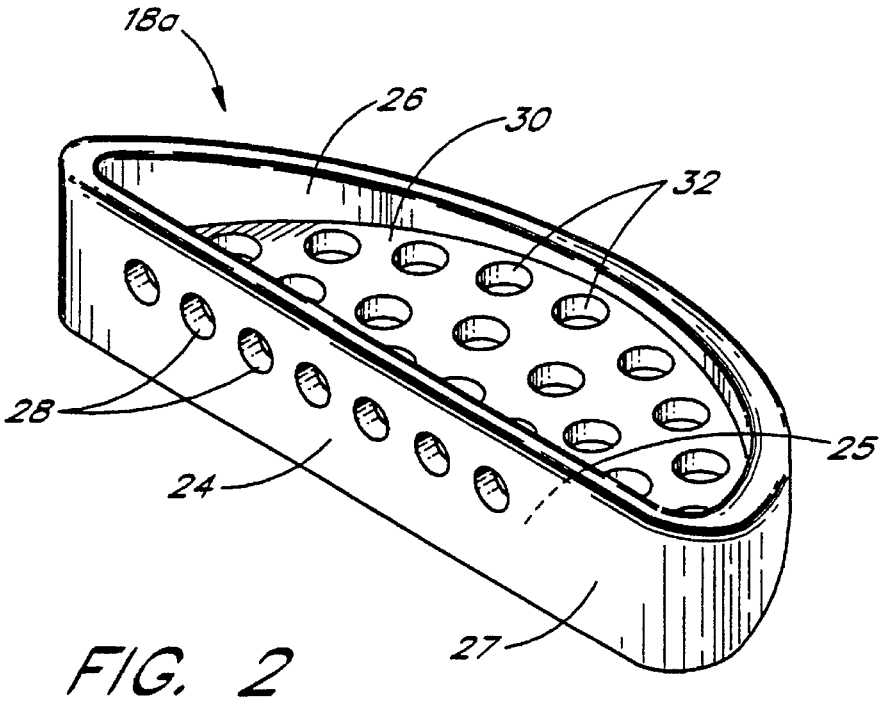
FIG. 2 is a perspective view of one of the pod's of FIG. 1 illustrating the screw-receiving holes in the internal wall of the pod.

Referring to FIG. 2, a perspective view of the pod 18*a* is shown illustrating the pattern of the screw-receiving holes 28 in the internal wall 24. In the preferred embodiment, the screw-receiving holes 28 are arranged in a linear pattern along the internal wall 24 of the pod 18*a*. The pattern comprises a total of nine holes 28, spaced approximately 2 cm apart. As previously explained, the holes 28 are used as an attachment and adjustment means for the heel loop 16. Thus, if a snowboard rider's foot is not properly centered, from toe to heel, between the pods 18, the heel loop 16 can slide forward or backward so that the foot may be properly positioned within the binding. For ease of description, the term "forward" (or front) will refer to "toward the nose of the snowboard" and the term "backward" (or back) will refer to "toward the tail of the snowboard".

An example of how the heel loop 16 is adjusted to properly accommodate the rider's foot is as follows. If the heel loop 16 does not contact the heel of the rider's foot, when the rider's foot is properly positioned or centered (from front to back) within the binding, the heel loop 16 must be moved forward until it contacts the heel of the rider. This is accomplished by first removing the screws or inserts that attach the adjustment arms 20 of the heel loop 16 to the internal walls 24 of the pod 18*a*. Next, the adjustment arms 20 are moved forward until the heel loop 16 contacts the heel of the rider and the holes (not shown) in the adjustment arms 20 are aligned with the holes 28 in the internal wall 24. At this point, the adjustment arms 20 are attached or secured to the pod 18*a* via screws or inserts threaded through the aligned holes.

In another embodiment, the number of holes 28 and, subsequently, the spacing between the holes 28 in the internal wall 24 of the pod 18*a* may be increased or decreased to provide the user of the device with a variety of adjustment capabilities. In yet another embodiment, the holes in the adjustment arm 20 of the heel loop 16 or the holes 28 in the internal wall 24 of the pod 18*a* may be replaced by a slot. This embodiment would allow for the heel loop 16 to be adjusted infinitely along the length of the internal wall 24 of the pod 18*a*. In addition, the heel loop 16 may be attached either to the outside surface 27 or the inside surface 25 of the internal wall 24 of the pod 18*a*. Various other embodiments of attaching the heel loop 16 to the pod 18*a* may also be used, which would be easily recognized by one skilled in the art.

Figure 3:
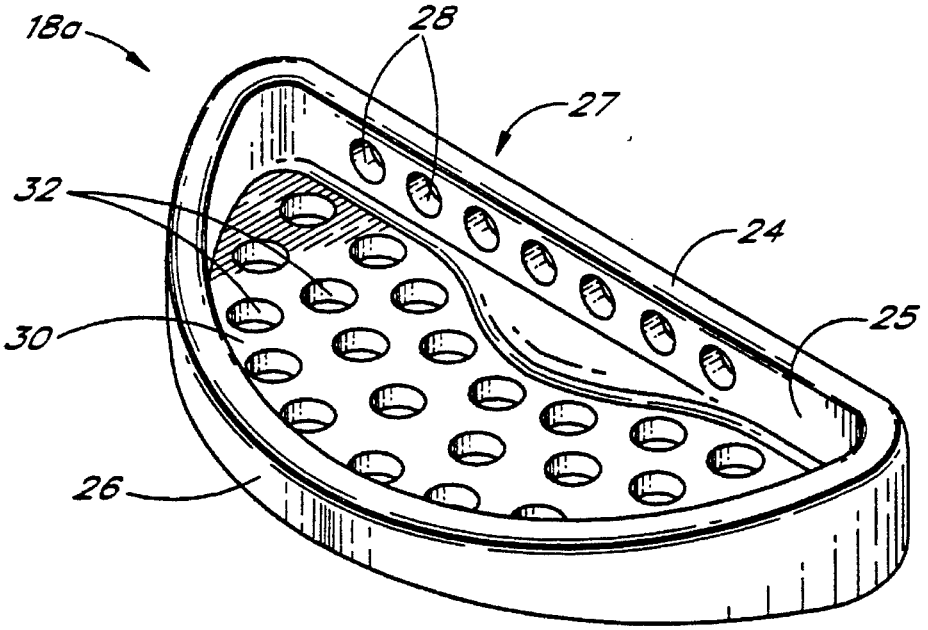
FIG. 3 is a perspective view of one of the pod's of FIG. 1 illustrating the repeating radial pattern of the screw-receiving holes of the base.

FIG. 3 is a perspective view of the binding of the present invention illustrating the pattern of screw-receiving holes 32 in the base 30 of the pod 18*a*. The screw-receiving holes 32 are used to secure each pod 18*a*,18*b* to the surface of the snowboard. In addition, the holes 32, in combination with the pattern of holes or inserts located within the surface of the snowboard (not shown), enable the user of the device to rotate the binding to a variety of angles and to position the binding to accommodate a variety of foot widths and stances.

In the preferred embodiment shown in FIG. 3, the screw-receiving holes 28 are arranged in a radial pattern that follows the radius of curvature of the external wall 26 of the pod 18*a*. In addition, the radial pattern of the screw-receiving holes 32 is repeated three times, whereby the pattern of holes 32 near the internal wall 24 is of a smaller radius of curvature than the pattern of holes 32 near the external wall 26 of the pod 18*a*.

For this preferred embodiment, a total of thirty-seven holes 32, arranged in a radial pattern, are located in the base 30. This particular hole number and pattern allows the user of the device to rotate the binding, on an axis normal to the board, to a variety of different angles. In another embodiment, only two holes 32 are located in the base 30 of the pod 18*a*. However, this embodiment does not allow the user of the device to rotate the binding to different angles. In order to enable a user to rotate the binding to at least one other angle, there would have to be a minimum of 6 holes 32 located in the base 30 of each pod 18*a*,18*b*. Other embodiments of the number and location of holes 32 in the base 30 of the pod 18*a* may also be used, which would be easily recognized by one skilled in the art.

Figure 4:
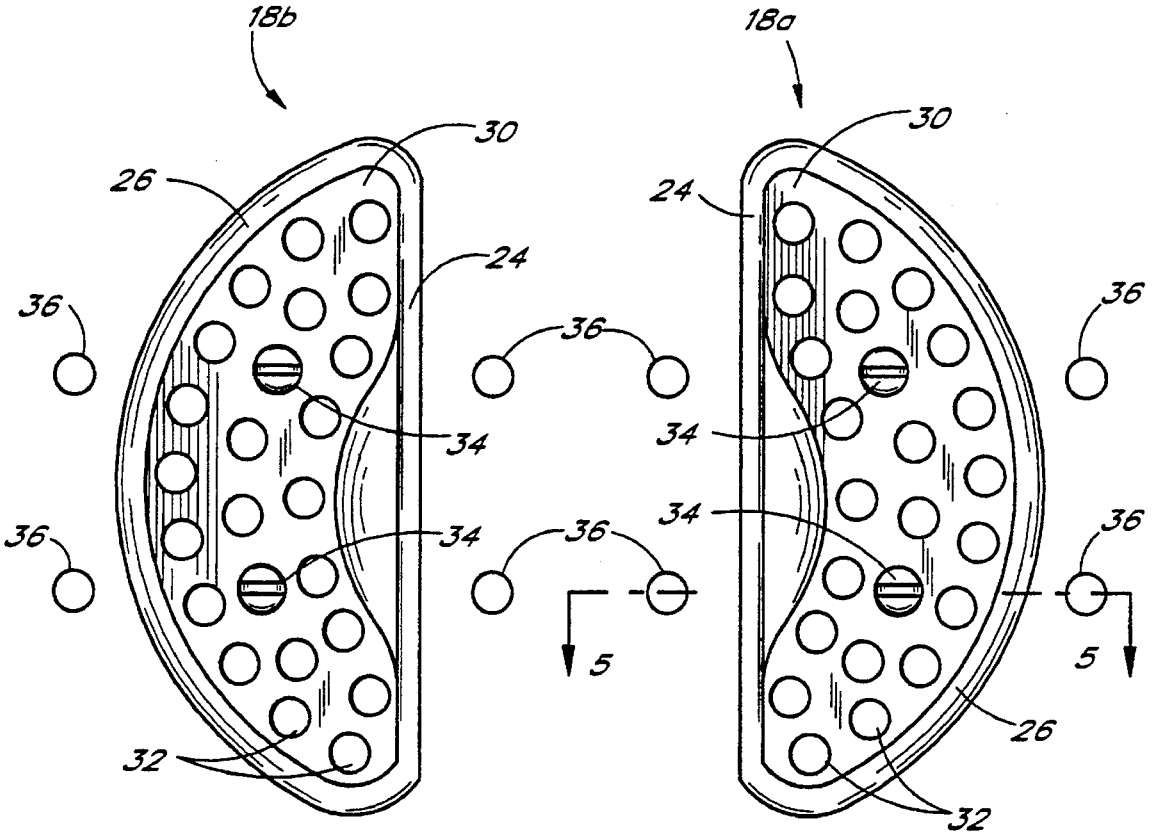
FIG. 4 is a partial top view of the pods of FIG. 1 mounted onto a snowboard.
Figure 5:
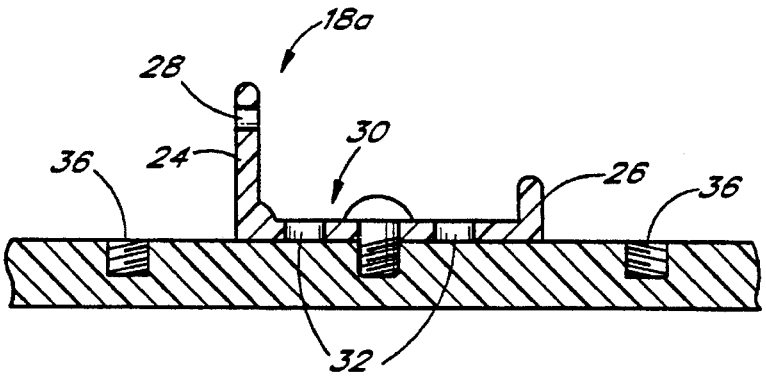
FIG. 5 is a cross sectional view taken along line 5—5 of FIG. 4 illustrating the pod mounted onto the snowboard.

A partial illustration of a top view of the pods 18 mounted to the surface of a snowboard is shown in FIG. 4. As shown in FIG. 4, each pod 18*a*,18*b* is attached via two screws 34 to the surface of the snowboard. Threaded inserts are located within the holes 36 in the surface of the snowboard. Therefore, referring to FIG. 5, each pod 18*a* is secured to the surface to the snowboard simply by inserting two screws 34 through the holes 32 in the base 30 of the pod 18*a* and threading the screws 34 into the inserts.

Referring back to FIG. 4, the pattern of holes 36 located on the snowboard is the currently used 4 cm×4 cm square. For the preferred embodiment of the present invention, the hole pattern located on the snowboard is a 5 cm× 5 cm square. However, the 4 cm×4 cm pattern, or other comparable patterns, could also be used in combination with the present invention.

The particular pattern of the holes 36 in the snowboard, in combination with the versatile design of the pods 18, allows the snowboard rider to mount his bindings to the snowboard at the perimeter or outside of his boot, rather than beneath his boot as with traditional bindings. By mounting the bindings to the snowboard at the outside footprint of the rider's boot, there is nothing between the sole of the rider's boot and the surface of the snowboard. Thus, the snowboard rider is able to stand directly in contact with the board, thereby increasing the rider's sensitivity to the board.

There are three main advantages associated with the snowboard binding system 10 of the present invention. The first main advantage is directed toward the snowboard rider's center of gravity. By moving the snowboard binding attachment area from beneath the rider's feet to the perimeter of the rider's feet, the rider is now in direct contact with the surface of the board. Traditional snowboard bindings are approximately 0.8 cm thick. Thus, by removing the binding material from beneath the rider's feet, the rider's center of gravity is subsequently lowered approximately 0.8 cm. This lower center of gravity provides the rider with enhanced balancing and maneuvering capabilities.

The second main advantage of the snowboard binding system of the present invention is related to the feel of the ride. Again, by positioning the bindings to the outside of the rider's foot, the snowboard rider's boot is in direct contact with the surface of the snowboard. This direct contact gives a unique feel to the ride and, additionally, increases the rider's sensitivity to the snowboard.

The third main advantage of the present invention is the versatility associated with the adjustment capabilities of the pods 18. The various adjustment options given to the rider to enable him to customize his position on the board are far superior to those offered by traditional binding systems. The binding system 10 of the present invention allows the rider to rotate the binding to any one of a number of different angles. In addition, the rider is able to adjust the bindings for various foot stances (i.e., distance between his feet) and foot widths.

An additional advantage associated with the binding system 10 of the present invention is added board flexibility. This is due to the specific size, shape and location of the pods 18. Each pod 18 is typically smaller in size than a traditional foot-plate binding and each pod is mounted to the snowboard at the outside perimeter of the rider's boot. Therefore, unlike the traditional binding systems which offer only three snowboard flexing areas, the binding system 10 of the present invention offers five snowboard flexing areas. Thus, the board is able to flex more freely and uniformly, thereby enabling the rider to hold a better edge while turning.

Thus, the snowboard binding system 10 of the present invention enables a snowboard rider to customize his foot positions on the board and increases his sensitivity to and feel for the board.

Obviously, numerous variations and modifications can be made without departing from the spirit of the present invention. Therefore, it should be clearly understood that the forms of the present invention described above and shown in the figures of the accompanying drawings are illustrative only and are not intended to limit the scope of the present invention.

What is claimed is:

1. A snowboard and binding, comprising:

a snowboard defining an upper surface, a lower surface, a first pattern of threaded holes extending between said upper surface and said lower surface and a second pattern of threaded holes extending between said upper surface and said lower surface;

a first pod defining a first base defining a first horizontal contact surface positioned against said upper surface of said snowboard and a first wall defining a first generally vertical surface, said first pod defining a first plurality of holes, at least two of said first plurality of holes being alignable with at least two of said first pattern of threaded holes when said first pod and said snowboard have a first angular orientation relative one another and at least two of said first plurality of holes being alignable with at least two of said first pattern of threaded holes when said first pod and said snowboard have a second angular orientation relative one another;

a second pod defining a second base defining a second horizontal contact surface positioned against said upper surface of said snowboard and a second wall defining a second generally vertical surface facing said first generally vertical surface, said second pod defining a second plurality of holes, at least two of said second plurality of holes being alignable with at least two of said second pattern of threaded holes when said first pod and said snowboard have a second angular orientation relative one another and said first pod is generally parallel to said second pod, and at least two of said second plurality of holes being alignable with at least two of said second pattern of threaded holes when said second pod and said snowboard have a second angular orientation relative one another and said first pod is generally parallel to said second pod;

a toe strap secured to one of said first pod and said second pod;

an ankle strap secured to one of said first pod and said second pod;

a heel loop secured to said first pod and said second pod, said first pod, said second pod, said toe strap and said heel loop cooperating to secure a boot of a rider directly against said upper surface of said snowboard, wherein each of said first and second plurality of holes form a radial pattern, each of said first and second plurality of holes comprises three rows of radially aligned holes, and each of said first and second pattern of holes define a rectangular pattern.

2. The snowboard and binding of claim 1, wherein each of said first and second plurality of holes comprises three rows of radially aligned holes.

3. The binding of claim 1, wherein each of said first and second pods has a width between 2 and 10 centimeters.

4. The binding of claim 3, wherein each of said first and second pods has a length between 5 and 25 centimeters.

5. The binding of claim 4, wherein said heel loop is adjustably mounted to said first wall and said second wall.

* * * * *